US007900906B2

(12) United States Patent
Roberts et al.

(10) Patent No.: US 7,900,906 B2
(45) Date of Patent: Mar. 8, 2011

(54) APPARATUS AND METHOD FOR CONTROLLING FEED COMMITMENTS BASED ON FEEDABLE CAPACITY

(75) Inventors: Aldwin A. Roberts, Macedon, NY (US); Michele Donna Cleary, Rochester, NY (US); David L. Rasmussen, Fairport, NY (US); Biruk Gossaye, Rochester, NY (US); Lawrence Dee Dipzinski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 352 days.

(21) Appl. No.: 12/195,843

(22) Filed: Aug. 21, 2008

(65) Prior Publication Data

US 2010/0044955 A1 Feb. 25, 2010

(51) Int. Cl.
*B65H 83/00* (2006.01)

(52) U.S. Cl. ..... 271/3.14

(58) Field of Classification Search ..... 271/3.14, 271/3.15, 258.01, 258.02, 258.04
See application file for complete search history.

(56) References Cited

U.S. PATENT DOCUMENTS 6,856,411 B1 2/2005 Purvis et al.
7,310,108 B2 12/2007 Moore
7,503,561 B2 * 3/2009 Totsuka et al. ..... 271/265.01

* cited by examiner

*Primary Examiner* — Stefanos Karmis
*Assistant Examiner* — Gerald W McClain
(74) *Attorney, Agent, or Firm* — Matthew C. Loppnow; Prass LLP

(57) ABSTRACT

A method (200) and apparatus (100) control feed commitments based on feedable capacity. The apparatus may include a source (122) of feedable media sheets and a feeder module (120) coupled to the source of feedable media sheets, the feeder module configured to control the source of feedable media sheets. The apparatus may include a marking engine (132) coupled to the source of feedable media sheets, the marking engine configured to mark images on media sheets fed by the source of feedable media sheets. The apparatus may include a marker module (130) coupled to the marking engine, the marker module configured to control the marking engine. The apparatus may include a scheduler module (110) coupled to the feeder module and the marker module, the scheduler module configured to schedule feed commitments for the feeder module and mark commitments for the marker module. The feeder module may be configured to determine whether there will be a future low media sheet count based on comparing a predetermined number with an outstanding sheet feed commitment amount and may be configured to assert a break in feed commitments if there will be a future low media sheet count.

19 Claims, 2 Drawing Sheets

APPARATUS AND METHOD FOR CONTROLLING FEED COMMITMENTS BASED ON FEEDABLE CAPACITY

BACKGROUND

Disclosed herein is an apparatus and method that controls feed commitments based on feedable capacity.

Presently, a media sheet marking device, such as a copier or printer, that feeds media sheets can include a scheduler and a media sheet source, as well as a marking engine and a media sheet stacker. In a marking engine, such as a xerographic marking engine, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within a document. Subsequently, the electrostatic latent image on the photoconductive insulating surface is made visible by developing the image with a developing material. Generally, the developing material comprises toner particles adhering triboelectrically to carrier granules. The developed image is subsequently transferred to a sheet of media, such as a sheet of paper, a transparency, or other sheet of media, that is fed from a media sheet source. A stacker can then stack the marked media sheets. A scheduler can schedule feed commitments for a number of sheets to be fed by the media sheet source, marked by the marking engine, and stacked by the stacker. For example, the scheduler can inform each element that a certain number of sheets will be processed by the elements. As one of the scheduled elements, a media sheet source must plan and commit to a variable number of feed commitments.

Unfortunately, the feedable capacity of the media sheet source may not be sufficient to satisfy outstanding feed commitments scheduled by the scheduler. For example, the media sheet source feed tray may not contain enough media sheets to meet the outstanding feed commitments. An unscheduled shutdown or jam can result from the media sheet source attempting to feed sheets after the feed tray is empty, which can require a machine operator to clear the entire media sheet path. Attempting to feed sheets after the feed tray is empty can also result in damage the media sheet source. Furthermore, other elements, such as the marking engine and the stacker can be damaged if they attempt to process scheduled, but unfed sheets. This can occur when a media sheet source does not include a sheet sensor for sensing the availability of sheets. To attempt to avoid damage, a media sheet source may stop feeding sheets prematurely. However, because the media sheet source cannot adequately control its feed commitments based on its feedable capacity, it will stop feeding sheets even though the feed tray it not empty.

Thus, there is a need for method and apparatus that controls feed commitments based on feedable capacity.

SUMMARY

A method and apparatus that controls feed commitments based on feedable capacity. The apparatus may include a source of feedable media sheets and a feeder module coupled to the source of feedable media sheets, where the feeder module may be configured to control the source of feedable media sheets. The apparatus may include a marking engine coupled to the source of feedable media sheets, where the marking engine may be configured to mark images on media sheets fed by the source of feedable media sheets. The apparatus may include a marker module coupled to the marking engine, where the marker module may be configured to control the marking engine. The apparatus may include a scheduler module coupled to the feeder module and the marker module, where the scheduler module may be configured to schedule feed commitments for the feeder module and mark commitments for the marker module. The feeder module may be configured to determine whether there will be a future low media sheet count based on comparing a predetermined number with an outstanding sheet feed commitment amount and may be configured to assert a break in feed commitments if there will be a future low media sheet count.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
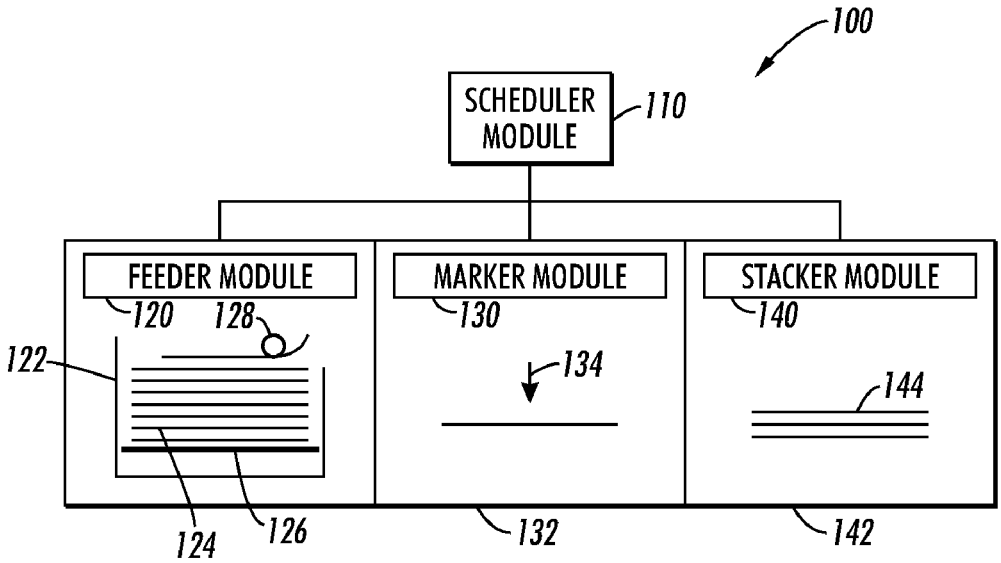
FIG. 1 is an exemplary illustration of an apparatus.

The embodiments include an apparatus that controls feed commitments based on feedable capacity. The apparatus can include a source of feedable media sheets and a feeder module coupled to the source of feedable media sheets, the feeder module configured to control the source of feedable media sheets. The apparatus can include a marking engine coupled to the source of feedable media sheets, the marking engine configured to mark images on media sheets fed by the source of feedable media sheets. The apparatus can include a marker module coupled to the marking engine, the marker module configured to control the marking engine. The apparatus can include a scheduler module coupled to the feeder module and the marker module, the scheduler module configured to schedule feed commitments for the feeder module and mark commitments for the marker module. The feeder module can be configured to ascertain a number of feedable media sheets that satisfy outstanding feed commitments scheduled by the scheduler module to obtain an outstanding sheet feed commitment amount. The feeder module can be configured to compare a predetermined number with the outstanding sheet feed commitment amount, where the predetermined number can be related to a feedable capacity of the source of feedable media sheets. The feeder module can be configured to determine whether there will be a future low media sheet count based on comparing the predetermined number with the outstanding sheet feed commitment amount, and configured to assert a break in feed commitments if there will be a future low media sheet count.

The embodiments further include an apparatus that controls feed commitments based on feedable capacity. The apparatus can include a source of feedable media sheets including a feed tray and a feed head, the feed tray configured to direct media sheets to the feed head and the feed head configured to feed the media sheets. The apparatus can include a feeder module coupled to the source of feedable media sheets, where the feeder module can be configured to control the source of feedable media sheets. The apparatus can include a marking engine configured to mark images on media sheets fed by the source of feedable media sheets. The apparatus can include a marker module coupled to the marking engine, the marker module configured to control the marking engine. The apparatus can include a scheduler module coupled to the feeder module and the marker module, the scheduler module configured to schedule a number of feed commitments for the feeder module and schedule a number of mark commitments for the marker module. The feeder module can be configured to provide a predetermined number based on an amount of travel left in the feed tray before the feed tray substantially reaches the feed head in the source of feedable media sheets. The feeder module can configured to ascertain a number of feedable media sheets that satisfy an outstanding number feed commitments scheduled by the scheduler module to obtain an outstanding sheet feed commitment amount. The feeder module can be configured to compare the predetermined number with the outstanding sheet feed commitment amount. The feeder module can configured to determine whether there will be a future low media sheet count based on the predetermined number being less than the outstanding sheet feed commitment amount. The feeder module can be configured to suspend future feed commitments if there will be a future low media sheet count.

The embodiments further include a method that controls feed commitments based on feedable capacity in an apparatus including source of feedable media sheets. The method can include ascertaining a number of feedable media sheets that satisfy outstanding feed commitments to obtain an outstanding sheet feed commitment amount. The method can include comparing a predetermined number with the outstanding sheet feed commitment amount, where the predetermined number is related to a feedable capacity of the source of feedable media sheets. The method can include determining whether there will be a future low media sheet count based on comparing the predetermined number with the outstanding sheet feed commitment amount. The method can include asserting a break in feed commitments if there will be a future low media sheet count.

FIG. 1 is an exemplary illustration of an apparatus 100. The apparatus 100 may be a document feeder, a printer, a scanner, a multifunction device, a xerographic machine, or any other device that transports media. The apparatus 100 can include a source of feedable media sheets 122 that can include feedable media sheets 124. The apparatus 100 can include a feeder module 120 coupled to the source of feedable media sheets 122. The feeder module 120 can be configured to control the source of feedable media sheets 122. The apparatus 100 can include a marking engine 132 coupled to the source of feedable media sheets 122. The marking engine 132 can be configured to mark 134 images on media sheets fed by the source of feedable media sheets 122. The apparatus 100 can include a marker module 130 coupled to the marking engine 132. The marker module can be configured to control the marking engine 132. The apparatus 100 can include a scheduler module 110 coupled to the feeder module 120 and the marker module 130. The scheduler module 110 can be configured to schedule feed commitments for the feeder module 120 and mark commitments for the marker module 130.

The feeder module 120 can be configured to ascertain a number of feedable media sheets that satisfy outstanding feed commitments scheduled by the scheduler module 110 to obtain an outstanding sheet feed commitment amount. Feed commitments can represent a number of media sheets scheduled for processing by the scheduler module 110. For example, the scheduler module 110 can schedule a number of media sheets for processing by the feeder module 120, the marker module 130, and the stacker module 140. The feeder module 120 can process the number of media sheets by feeding the number of media sheets. The marker module 130 can process the number of media sheets by marking 134 an image on each of the number of media sheets fed by the feeder module 120. The stacker module 140 can process the number of media sheets by stacking 144 each of the number of media sheets marked by the marker module 130.

The feeder module 120 can be configured to compare a predetermined number with the outstanding sheet feed commitment amount. The predetermined number can be related to a feedable capacity of the source of feedable media sheets. The feeder module 120 can be configured to determine whether there will be a future low media sheet count based on comparing the predetermined number with the outstanding sheet feed commitment amount. The feeder module can determine whether there will be a future low media sheet count based on the predetermined number being less than the outstanding sheet feed commitment amount.

For example, the feeder module 120 can be configured to determine a predetermined number by estimating a feedable capacity of the source of feedable media sheets 122 to obtain a feedable capacity estimate. The feeder module 120 can estimate the feedable capacity of the source of feedable media sheets 122 based on a number of currently available feedable media sheets in the source of feedable media sheets 122. The feeder module 120 can also estimate the feedable capacity of the source of feedable media sheets 122 based on a media sheet thickness of media sheets in the source of feedable media sheets 122. The source of feedable sheets 122 can include a feed tray 126 and a feed head 128. The feeder module 120 can estimate the feedable capacity estimate based on an amount of travel left in the feed tray 126 before the feed tray 126 reaches the feed head 128. The predetermined number can also be obtained by a user input, can be stored in a memory, can be provided by the feeder module 120, can be determined by other factors related to a feedable capacity of the source of feedable media sheets 122, or can be based on any other useful information.

The feeder module 120 can be configured to assert a break in feed commitments if there will be a future low media sheet count. As used herein, "asserting" and "asserting a break" shall be defined as initiating any alteration in intended operation of the apparatus 100. The feeder module can assert a break in feed commitments by informing the scheduler module 110 the feeder module 120 is unable to operate on future feed commitments. The feeder module 120 can also assert a break in feed commitments by suspending the feeding of media sheets from the source of feedable media sheets 122. The feeder module 120 can also assert a break in feed commitments by outputting a warning indicating there will be a future low media sheet count and/or indicating the feedable capacity is less than the outstanding sheet feed commitment amount. For example, the apparatus 100 can include a user interface (not shown) that can inform an operator that there is or will be a low media sheet condition and that the source of feedable media sheets 122 should be refilled.

The apparatus 100 can also include a stacker 142 coupled to the marking engine 132. The stacker 142 can stack media sheets 144 marked by the marking engine 132. The stacker 142 can include a stacker module 140 that can be coupled to the scheduler module 110. The stacker module 140 can control the stacker 142. The scheduler module 110 can schedule stacking commitments for the stacker module 140.

For example, the scheduler module 110 can schedule a number of media sheets for the other modules 120, 130, and 140 in advance and the other modules 120, 130, and 140 can store the scheduled number of media sheets that will be operated on in the future. The feeder module 120 can then determine if it will be able to feed the scheduled number of media sheets. The feeder module 120 can make the determination based on the amount of travel left in a feed tray 126 before it reaches a feed head 128. The feeder module 120 can then inform the scheduler module 110 if the feeder module 120 will need to suspend feeding before feeding the scheduled number of media sheets because the feed tray 126 will become too close to the feed head 128. The feeder module 120 can inform the scheduler module 110 of the number of scheduled media sheets it will feed before suspending the feeding or at which scheduled media sheet it will suspend the feeding. The other modules, such as the marker module 130 and the stacker module 140, can then be informed of when sheet feeding will be suspended so the other modules can suspend operations accordingly and so they do not attempt to process unfed sheets. The scheduler module 110 can reschedule unprocessed media sheet commitments when the feeder module 120 is ready to feed more sheets.

According to another embodiment, the apparatus 100 can include a source of feedable media sheets 122 including a feed tray 126 and a feed head 128. The feed tray 126 can be configured to direct media sheets 124 to the feed head 128 and the feed head 128 can be configured to feed the media sheets 124. The apparatus 100 can include a feeder module 120 coupled to the source of feedable media sheets 122. The feeder module 120 can be configured to control the source of feedable media sheets 122. The apparatus 100 can include a marking engine 132 configured to mark 134 images on media sheets fed by the source of feedable media sheets 122. The apparatus 100 can include a marker module 130 coupled to the marking engine 132. The marker module 130 can be configured to control the marking engine 132. The apparatus 100 can include a scheduler module 110 coupled to the feeder module 120 and the marker module 130. The scheduler module 110 can be configured to schedule a number of feed commitments for the feeder module 120 and schedule a number of mark commitments for the marker module 130.

The feeder module 120 can be configured to obtain a feedable capacity estimate based on estimating a feedable capacity of the source of feedable media sheets 122 according to an amount of travel left in the feed tray 126 before the feed tray 126 substantially reaches the feed head 128 in the source of feedable media sheets 122. The feeder module 120 can determine the amount of travel left in the feed tray 126 based on a number of currently available feedable media sheets 124 in the source of feedable media sheets 122, based on a media sheet thickness of media sheets 124 in the source of feedable media sheets 122, based on a number of step instructions sent to a feed tray motor (not shown), or based on other information useful for determining an amount of travel left in a feed tray 126.

The feeder module 120 can be configured to ascertain a number of feedable media sheets that satisfy an outstanding number feed commitments scheduled by the scheduler module 110 to obtain an outstanding sheet feed commitment amount. The feeder module 120 can be configured to compare the feedable capacity estimate with the outstanding sheet feed commitment amount. The feeder module 120 can be configured to determine whether there will be a future low media sheet count based on the feedable capacity estimate being less than the outstanding sheet feed commitment amount. The feeder module 120 can be configured to suspend future feed commitments if there will be a future low media sheet count. The feeder module 120 can also be configured to inform the scheduler module 110 of a number of remaining feedable media sheets before feeding should be suspended. The scheduler module 110 can be configured to update the number of mark commitments sent to the marker module 130 based on the number of remaining feedable media sheets.

According to some embodiments, feeder software in a feeder module can plan and commit to a variable number of feed commitments as a function of an apparatus modular scheduling architecture. As a result, it can be possible for the number of commitments to exceed the feedable capacity of a source of feedable media sheets. This can result in an unscheduled shutdown or jam of the apparatus which can require an apparatus operator to clear an entire media path and can result in negative impacts to other apparatus subsystems, such as a marker engine or a stacker. When this condition of the number of commitments exceeding the feedable capacity of a source of feedable media sheets is detected, future scheduled sheet commitments can be suspended. A calculated feedable capacity estimate can be used to determine future low media count and a future break in feed commitments can be asserted to avoid an unscheduled shutdown, jam, and/or other negative impacts to the apparatus.

Embodiments can use a calculated sheet thickness to determine the feedable capacity estimate. For example, an operator can enter information regarding media sheet weight, size, thickness, paper type, paper weight, media type, and other relevant information to determine sheet thickness. Sheet thickness can also be determined as sheets are fed from the feed tray based on the number of sheets fed as compared to the travel distance of the feed tray.

A comparison can be made by comparing the number of outstanding feed commitments to a predicted estimate of the number of feedable sheets. When the predicted estimate of the number of remaining feedable sheets is determined to be less than the number of outstanding feed commitments, a break command can be asserted for future scheduled feed commitments. This can provide a predicted shutdown and can allow time to suspend remaining outstanding feed commitments. This can reduce negative impacts to the apparatus subsystems and can avoid a need for an apparatus operator to clear the entire media path due to an unscheduled shutdown or jam. This can also avoid damage to hardware can avert jams, and can allow an apparatus system to cycle down gracefully. This can also allow a source of feedable media sheets to run closer to an empty feed tray. Embodiments can also provide for the elimination of a sensor that detects a low amount of media in a feed tray because a feeder module can determine the amount of media in the feed tray without the sensor.

Figure 2:
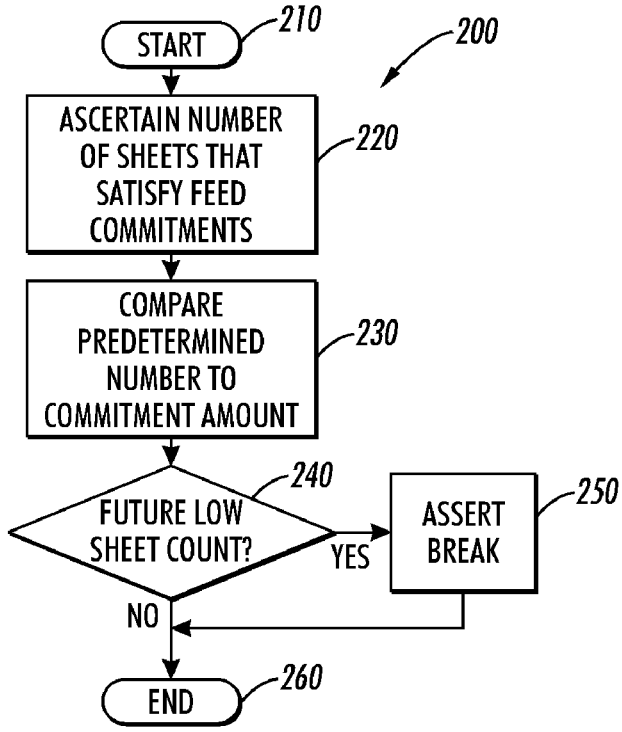
FIG. 2 is an exemplary flowchart of a method that controls feed commitments based on feedable capacity.

FIG. 2 illustrates an exemplary flowchart 200 of a method that controls feed commitments based on feedable capacity in an apparatus including source of feedable media sheets. The process can be performed in a feeder module of an apparatus, such as the apparatus 100, that generates marked images on fed media sheets. The process may also be performed by a controller, processor, or other useful module in such an apparatus.

The method starts at 210. At 220, a number of feedable media sheets that satisfy outstanding feed commitments can be ascertained to obtain an outstanding sheet feed commitment amount. At 230, a predetermined number can be compared with the outstanding sheet feed commitment amount. The predetermined number can be related to a feedable capacity of a source of feedable media sheets. The predetermined number can be obtained from a user input, can be stored in a memory, can be provided by a feeder module, can be determined by other factors related to a feedable capacity of a source of feedable media sheets, or can be based on any other useful information. The predetermined number can also be based on estimating a feedable capacity of a source of feedable media sheets to obtain a feedable capacity estimate. The feedable capacity estimate can be based on a number of currently available feedable media sheets in the source of feedable media sheets. The feedable capacity estimate can also be based on a media sheet thickness of media sheets in the source of feedable media sheets. The feedable capacity estimate can also be based on an amount of travel left in a feed tray before the feed tray reaches a feed head in the source of feedable media sheets. For example, the feedable capacity can represent the number of media sheets that can be fed by a feeder module before incurring any damage to a feeder or before incurring a jam in an apparatus having media sheets fed from a source of feedable media sheets. The feedable capacity can represent the number of media sheets that can be fed from a given tray in the source of feedable media sheets. As a further example, each time a feed tray is incremented to feed additional media sheets, it can move closer to a feed head. Damage can occur to the source of feedable media sheets or the feed head if the source attempts to keep feeding sheets after the source is empty or after a feed tray is too close to the feed head. Embodiments can allow the feed tray to get close to the feed head while avoiding damage to the feed head, while avoiding media sheet jams, and while avoiding other problems. Thus, the feedable capacity can also represent how close the feed tray can get to the feed head without creating a jam scenario, can represent how close the feed tray can get to the feed head without damaging hardware, or can represent close the feed tray can get to the feed head without causing any other problems.

The feedable capacity estimate can be calculated based on a feed tray height, based on a current position of the feed tray relative to a maximum position where the feed tray is close to the feed head, or based on other information for determining a feedable capacity estimate. The feedable capacity estimate of the source of feedable sheets can be continuously determined as the source feeds sheets. For example, as sheets are fed, a feeder module can keep track of the travel of the feed tray based on each increment of a feed tray as it gets closer to the feed head. The feeder module can keep track of the travel of the feed tray by keeping track of a number of steps of a feed motor that moves the feed tray until it stops and can correlate the number of steps to an amount of travel of the feed tray. To elaborate, a current position of the feed tray can be determined when initializing the tray by raising the feed tray from a bottom location to a point where the feed tray stops. The distance traveled can then be determined based on the number of steps of the feed motor to determine the current position of the feed tray based on how much the feed tray traveled. Thus, the feeder module can predict how much media will be left in a feed tray in the future and can predict future feed problems.

At 240, whether there will be a future low media sheet count can be determined based on comparing the predetermined number with the outstanding sheet feed commitment amount. Determining whether there will be a future low media sheet count can be based on the predetermined number being less than the outstanding sheet feed commitment amount.

If there will be a future low media sheet count, at 250 a break in feed commitments can be asserted. A break in feed commitments can be asserted by informing a scheduler there will be a future low media sheet count. For example, the break can be asserted to inform the scheduler that the amount of available feedable media is about to be extinguished in advance of the feedable media actually extinguishing. The break can further inform the scheduler that feeding should be suspended after a certain number of feeds. A break in feed commitments can also be asserted by suspending feeding of media sheets from the source of feedable media sheets. A break in feed commitments can be additionally asserted by outputting a warning indicating there will be a future low media sheet count. The warning can also indicate a feedable capacity estimate is less than the outstanding sheet feed commitment amount. For example, an operator can be notified that there is a low media sheet condition and that the feed tray should be refilled. At 260, the method can end or can continue operating.

Figure 3:
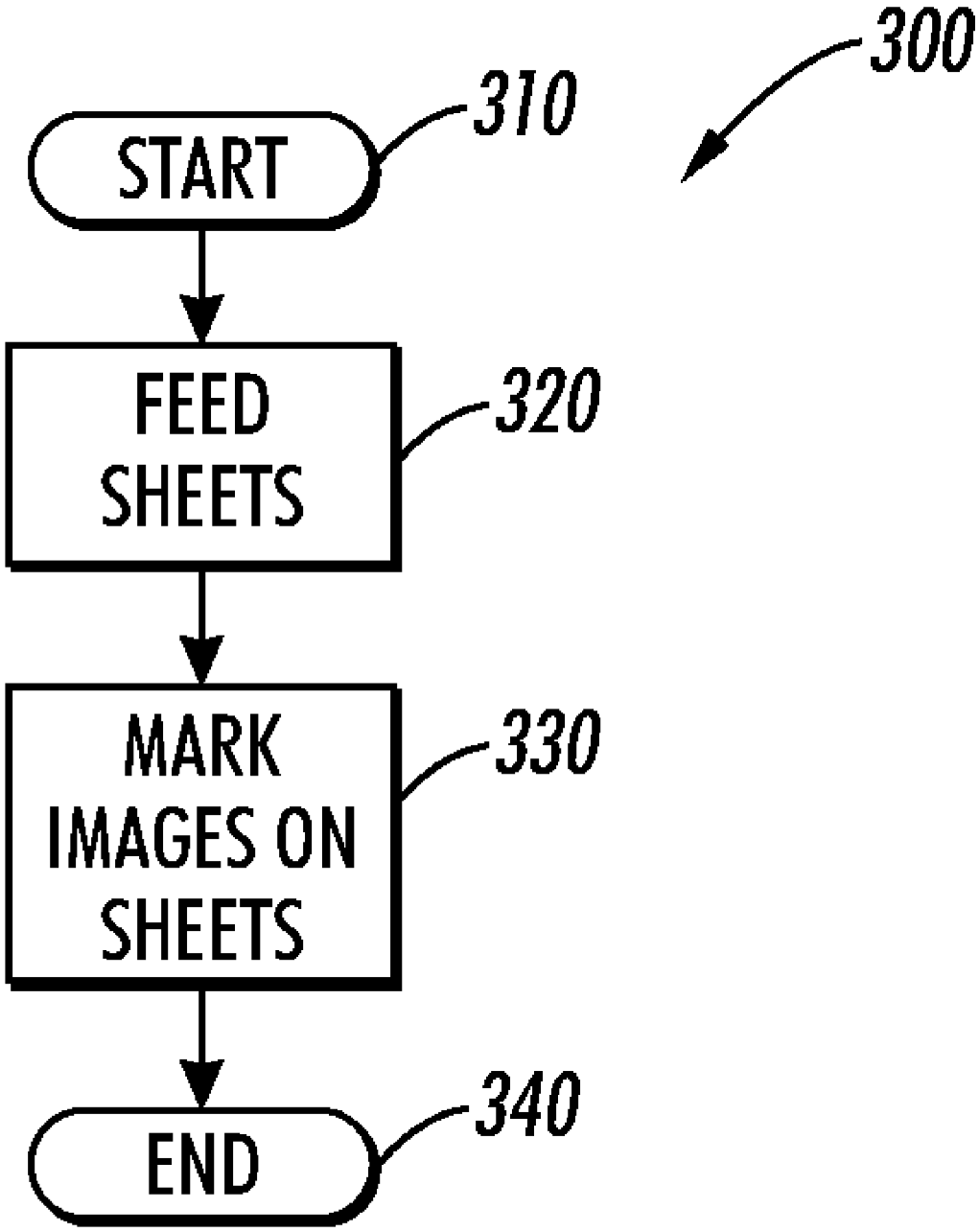
FIG. 3 is an exemplary flowchart of a method that controls feed commitments based on feedable capacity.

FIG. 3 illustrates an exemplary flowchart 300 of a related method that controls feed commitments based on feedable capacity. Elements of the flowchart 300 can be combined with elements of the flowchart 200. The method starts at 310. At 320, media sheets can be fed from the source of feedable media sheets to a media marking engine. At 330, images can be marked with the media marking engine on the media sheets fed from the source of feedable media sheets. At 340, the method can end or can continue operating.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in an apparatus including source of feedable media sheets, the method comprising:

ascertaining a number of feedable media sheets that satisfy outstanding feed commitments to obtain an outstanding sheet feed commitment amount;

comparing a predetermined number with the outstanding sheet feed commitment amount, where the predetermined number is related to a feedable capacity of the source of feedable media sheets;

determining whether there will be a future low media sheet count based on comparing the predetermined number with the outstanding sheet feed commitment amount; and asserting a break in feed commitments if there will be a future low media sheet count, wherein the predetermined number is based on an amount of travel left in a feed tray before the feed tray reaches a feed head in the source of feedable media sheets, and wherein asserting a break in feed commitments comprises suspending feeding of media sheets from the source of feedable media sheets.

2. The method according to claim 1, wherein the predetermined number is based on a number of currently available media sheets in given tray in the source of feedable media sheets.

3. The method according to claim 1, wherein the predetermined number is based on a media sheet thickness of media sheets in the source of feedable media sheets.

4. The method according to claim 1, wherein asserting a break in feed commitments comprises asserting a future break in feed commitments suspending feeding of media sheets from the source of feedable media sheets.

5. The method according to claim 1, wherein determining whether there will be a future low media sheet count comprises determining there will be a future low media sheet count based on the predetermined number being less than the outstanding sheet feed commitment amount.

6. The method according to claim 1, wherein asserting a break in feed commitments comprises informing a scheduler there will be a future low media sheet count.

7. The method according to claim 1, wherein asserting a break in feed commitments comprises outputting a warning indicating there will be a future low media sheet count.

8. The method according to claim 1, further comprising:

feeding media sheets from the source of feedable media sheets to a media marking engine; and marking, with the media marking engine, images on the media sheets fed from the source of feedable media sheets.

9. An apparatus comprising:

a source of feedable media sheets;

a feeder module coupled to the source of feedable media sheets, the feeder module controls the source of feedable media sheets;

a marking engine coupled to the source of feedable media sheets, the marking engine marks images on media sheets fed by the source of feedable media sheets;

a marker module coupled to the marking engine, the marker module controls the marking engine; and a scheduler module coupled to the feeder module and the marker module, the scheduler module schedules feed commitments for the feeder module and mark commitments for the marker module, wherein the feeder module ascertains a number of feedable media sheets that satisfy outstanding feed commitments scheduled by the scheduler module to obtain an outstanding sheet feed commitment amount, compares a predetermined number with the outstanding sheet feed commitment amount, where the predetermined number is related to a feedable capacity of the source of feedable media sheets, determines whether there will be a future low media sheet count based on comparing the predetermined number with the outstanding sheet feed commitment amount, and asserts a break in feed commitments if there will be a future low media sheet count, wherein the source of feedable sheets comprises a feed tray and a feed head, wherein the predetermined number is based on an amount of travel left in the feed tray before the feed tray reaches the feed head, and wherein the feeder module asserts a break in feed commitments by suspending the feeding of media sheets from the source of feedable media sheets.

10. The apparatus according to claim 9, wherein the predetermined number is based on a number of currently available media sheets in given tray in the source of feedable media sheets.

11. The apparatus according to claim 9, wherein the predetermined number is based on a media sheet thickness of media sheets in the source of feedable media sheets.

12. The apparatus according to claim 9, wherein the feeder module determines whether there will be a future low media sheet count based on the predetermined number being less than the outstanding sheet feed commitment amount.

13. The apparatus according to claim 9, wherein the feeder module asserts a break in feed commitments by informing the scheduler module the feeder module is unable to operate on future feed commitments.

14. The apparatus according to claim 9, wherein the feeder module asserts a break in feed commitments by outputting a warning indicating there will be a future low media sheet count.

15. The apparatus according to claim 9, wherein the feeder module asserts a future break in feed commitments if there will be a future low media sheet count.

16. An apparatus comprising:

a source of feedable media sheets including a feed tray and a feed head, the feed tray directs media sheets to the feed head and the feed head feeds the media sheets;

a feeder module coupled to the source of feedable media sheets, the feeder module controls the source of feedable media sheets;

a marking engine marks images on media sheets fed by the source of feedable media sheets;

a marker module coupled to the marking engine, the marker module controls the marking engine; and a scheduler module coupled to the feeder module and the marker module, the scheduler module schedules a number of feed commitments for the feeder module and schedule a number of mark commitments for the marker module, wherein the feeder module provides a predetermined number based on an amount of travel left in the feed tray before the feed tray substantially reaches the feed head in the source of feedable media sheets, wherein the feeder module ascertains a number of feedable media sheets that satisfy an outstanding number feed commitments scheduled by the scheduler module to obtain an outstanding sheet feed commitment amount, wherein the feeder module compares the predetermined number with the outstanding sheet feed commitment amount, wherein the feeder module determines whether there will be a future low media sheet count based on the predetermined number being less than the outstanding sheet feed commitment amount, wherein the feeder module asserts a break in feed commitments by suspending the feeding of media sheets from the source of feedable media sheets if there will be a future low media sheet count.

17. The apparatus according to claim 16, wherein the feeder module is also informs the scheduler module of a number of remaining feedable media sheets.

18. The apparatus according to claim 17, wherein the scheduler module updates the number of mark commitments sent to the marker module based on the number of remaining feedable media sheets.

19. The apparatus according to claim 16, wherein the feeder module asserts a break in feed commitments by suspending the feeding of future media sheets from the source of feedable media sheets if there will be a future low media sheet count.

* * * * *